US011162281B2

(12) United States Patent
Ramakrishna

(10) Patent No.: US 11,162,281 B2
(45) Date of Patent: Nov. 2, 2021

(54) ADJUSTABLE BACKSET LATCH

(71) Applicant: Schlage Lock Company LLC, Carmel, IN (US)

(72) Inventor: Manjunatha Ramakrishna, Bangalore (IN)

(73) Assignee: Schlage Lock Company LLC, Carmel, IN (US)

( * ) Notice: Subject to any disclaimer, the term of this patent is extended or adjusted under 35 U.S.C. 154(b) by 153 days.

(21) Appl. No.: 16/358,231

(22) Filed: Mar. 19, 2019

(65) Prior Publication Data

US 2019/0345737 A1 Nov. 14, 2019

Related U.S. Application Data

(62) Division of application No. 14/605,530, filed on Jan. 26, 2015, now Pat. No. 10,233,673.

(51) Int. Cl.
*E05B 63/06* (2006.01)
*E05C 1/16* (2006.01)

(52) U.S. Cl.
CPC ..... *E05B 63/06* (2013.01); *E05C 1/163* (2013.01); *Y10S 292/60* (2013.01); *Y10T 292/06* (2015.04)

(58) Field of Classification Search
CPC ..... Y10T 292/06; E05C 1/163; E05B 63/06; Y10S 292/60
See application file for complete search history.

(56) References Cited

U.S. PATENT DOCUMENTS 671,792 A * 4/1901 Comber ..... E05B 15/10 292/2
1,661,454 A * 3/1928 Wilson ..... E05B 55/005 70/448
1,701,790 A * 2/1929 Morin, Jr. ..... E05B 55/00 70/107
1,720,638 A * 7/1929 Wread ..... E05C 1/163 292/169.22
1,720,639 A * 7/1929 Wread ..... E05B 15/10 292/2
1,724,630 A * 8/1929 Wilson ..... E05B 63/06 292/169.21

(Continued)

FOREIGN PATENT DOCUMENTS

EP 1308590 A1 * 5/2003 ..... E05B 63/06
EP 1477626 A2 * 11/2004 ..... E05B 15/10

*Primary Examiner* — Carlos Lugo
(74) *Attorney, Agent, or Firm* — Taft Stettinius & Hollister LLP

(57) ABSTRACT

An adjustable latch configured to accommodate different backset lengths. The adjustable latch includes inner and outer housings, at least a portion of the inner housing being structured for axial and rotational displacement within the outer housing as an engagement projection of the inner housing is displaced about an adjustment slot of the outer housing. The apparatus may include a bolt assembly having a bolt rod and a latch bar, the bolt rod having projections that are structured to be adjacent to the latch bar when the bolt rod is at a first rotational position and at first or second axial positions. When the bolt rod is at a second rotational position, the axial positions of the bolt rod and the inner housing relative to at least the latch bar and outer housing, respectively, may be adjusted to adjust the backset setting of the latch.

20 Claims, 11 Drawing Sheets

(56) References Cited

U.S. PATENT DOCUMENTS 2,822,202 A * 2/1958 Welch ..... E05B 63/06 292/1.5
2,937,897 A * 5/1960 Soderberg ..... E05B 63/06 292/1.5
4,315,648 A * 2/1982 Labelle ..... E05C 1/04 292/145
4,492,394 A * 1/1985 Dignan ..... E05C 3/042 292/64
4,662,666 A * 5/1987 Wimmer ..... E05C 1/163 292/1.5
4,664,433 A 5/1987 Solovieff
4,725,086 A 2/1988 Shen
4,752,090 A 6/1988 Lin
4,759,576 A 7/1988 Ching
4,767,140 A 8/1988 Lin
4,772,055 A 9/1988 Fang
4,840,412 A 6/1989 Shen
4,957,315 A 9/1990 Lin
4,979,768 A 12/1990 Marotto et al.
5,123,684 A * 6/1992 Yeh ..... E05B 63/044 292/244
5,152,558 A 10/1992 Smith et al.
5,364,138 A 11/1994 Dietrich et al.
5,395,144 A 3/1995 Galindo
5,489,128 A 2/1996 Florian
5,562,314 A 10/1996 Wheatland et al.
5,666,830 A * 9/1997 Litvin ..... E05B 9/00 292/165
5,957,510 A 9/1999 Kuo
6,536,812 B1 3/2003 Winardi
6,578,884 B2 * 6/2003 Chiang ..... E05B 1/0092 292/200
6,688,660 B2 * 2/2004 Huang ..... E05B 63/06 292/1.5
6,764,112 B2 7/2004 Lan-Shi et al.
6,880,871 B2 4/2005 Winardi
7,607,701 B2 10/2009 Levine
7,695,032 B2 4/2010 Bodily
8,118,334 B2 * 2/2012 Ramsauer ..... E05C 3/042 292/251
8,360,482 B2 1/2013 Viviano
9,624,700 B2 * 4/2017 Wollacott ..... E05B 63/06
10,233,673 B2 * 3/2019 Ramakrishna ..... E05B 63/06
2004/0130162 A1 7/2004 Don et al.
2007/0052250 A1 3/2007 Bodily et al.

* cited by examiner

ADJUSTABLE BACKSET LATCH

CROSS REFERENCE TO RELATED APPLICATIONS

The present application is a divisional of U.S. patent application Ser. No. 14/605,530 filed Jan. 26, 2015 and issued as U.S. Pat. No. 10,233,673, the contents of which are incorporated herein by reference in their entirety.

BACKGROUND

Embodiments of the present invention generally relate to adjustable latch mechanisms. More particularly, but not exclusively, embodiments of the present invention relate to adjustable backset mechanisms for cylindrical locks.

Cylindrical locksets typically include a cylindrical lock chassis that is engaged by a latch assembly. Referencing FIG. 1, at least a portion of the lock chassis typically is installed in a cylindrical hole or opening 102 in a door 100, such as, for example, in a 2⅛ inch diameter hole or opening. The distance (as indicated by "D" in FIG. 1) between the centerline 104 of the opening 102 relative to a side edge 106 of the door 100 is often referred to as the backset. The latch assembly that mates with the lock chassis often extends through a latch hole 108 that extends from the side edge 106 of the door 100 to the cylindrical hole or opening 102. However, the distance that the latch assembly is to extend along at least the latch hole 108 so as to operably engage the lock chassis may vary. More specifically, the backset may vary for different doors and/or applications. For example, traditionally, door backsets may be either 2⅜ inches or 2¾ inches. Thus, proper installation of latch assembly often requires that the latch assembly be configured to accommodate the particular backset for that door. If this criterion is not met, the lockset may fail to function properly.

BRIEF SUMMARY

An aspect of the present invention is an apparatus comprising an inner housing that has an engagement projection, and an outer housing having an outer housing wall that defines an interior region of the outer housing. Further, at least a portion of the inner housing is structured for axial and rotational displacement within the interior region. The outer housing wall includes an adjustment slot that is structured to receive the insertion of the engagement projection. The apparatus also includes a bolt assembly having a bolt rod and a latch bar, at least a portion of the latch bar being positioned within the inner housing. The bolt rod has a first projection and a second projection, the first projection being positioned to be adjacent to the latch bar when the bolt rod is at both a first axial position and a first rotational position. The second projection is positioned to be adjacent to the latch bar when the bolt rod is at both a second axial position and the first rotational position. Additionally, the first and second retention projections are structured to be disengaged from the latch bar when the bolt rod is at a second rotational position.

Another aspect of the present invention is an apparatus having an inner housing that includes an engagement projection, and an outer housing that is structured to accommodate axial and rotational displacement of the inner housing within the outer housing. The outer housing also includes an adjustment slot that is structured to receive the insertion of the engagement projection. The apparatus also includes a bolt assembly having a latch bolt, a bolt rod, and a latch bar. A first end of the bolt rod is coupled to the latch bolt, and at least a portion of the latch bar is positioned within the inner housing. Additionally, the bolt rod has a first pair of retention projections and a second pair of retention projections. The latch bar includes an aperture that is structured to receive passage of at least one retention projection of the first and second pairs of retention projections as the engagement projection is axially displaced from a first axial position to a second axial position along an axial slot of the adjustment slot.

Another aspect of the present invention is an apparatus having a housing assembly that includes an inner housing and an outer housing. The engagement projection of the inner housing is positioned for displacement along an adjustment slot of the outer housing. The apparatus also includes a bolt assembly having a latch bolt, a retention rod, and a latch bar. At least a portion of the latch bar is positioned within the inner housing. Further, the retention rod is threadingly coupled to the latch bar. Additionally, at least the axial position of the latch bar relative to a rear side of the latch bolt is adjusted as the inner housing is rotatably and axially displaced relative to the outer housing from a first position to a second position. Further, the engagement projection is at a first end of the adjustment slot when the inner housing is at the first position, and at a second, opposite end of the adjustment slot when the inner housing is at the second position.

BRIEF DESCRIPTION OF THE DRAWINGS

The description herein makes reference to the accompanying figures wherein like reference numerals refer to like parts throughout the several views.

Figure 1:
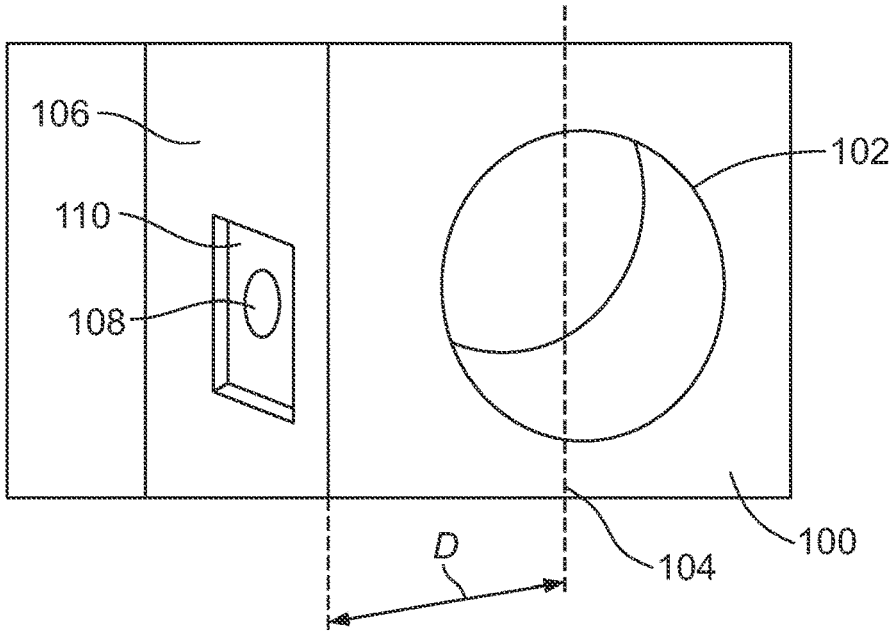
FIG. 1 illustrates a perspective view of a portion of a door having a cylindrical hole or opening that is configured to receive a portion of a cylindrical lockset, and which is positioned at a distance, or backset, from a side edge of the door.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DESCRIPTION OF THE ILLUSTRATED EMBODIMENTS

Certain terminology is used in the foregoing description for convenience and is not intended to be limiting. Words such as "upper," "lower," "top," "bottom," "first," and "second" designate directions in the drawings to which reference is made. This terminology includes the words specifically noted above, derivatives thereof, and words of similar import. Additionally, the words "a" and "one" are defined as including one or more of the referenced item unless specifically noted. The phrase "at least one of" followed by a list of two or more items, such as "A, B or C," means any individual one of A, B or C, as well as any combination thereof.

Figure 2:
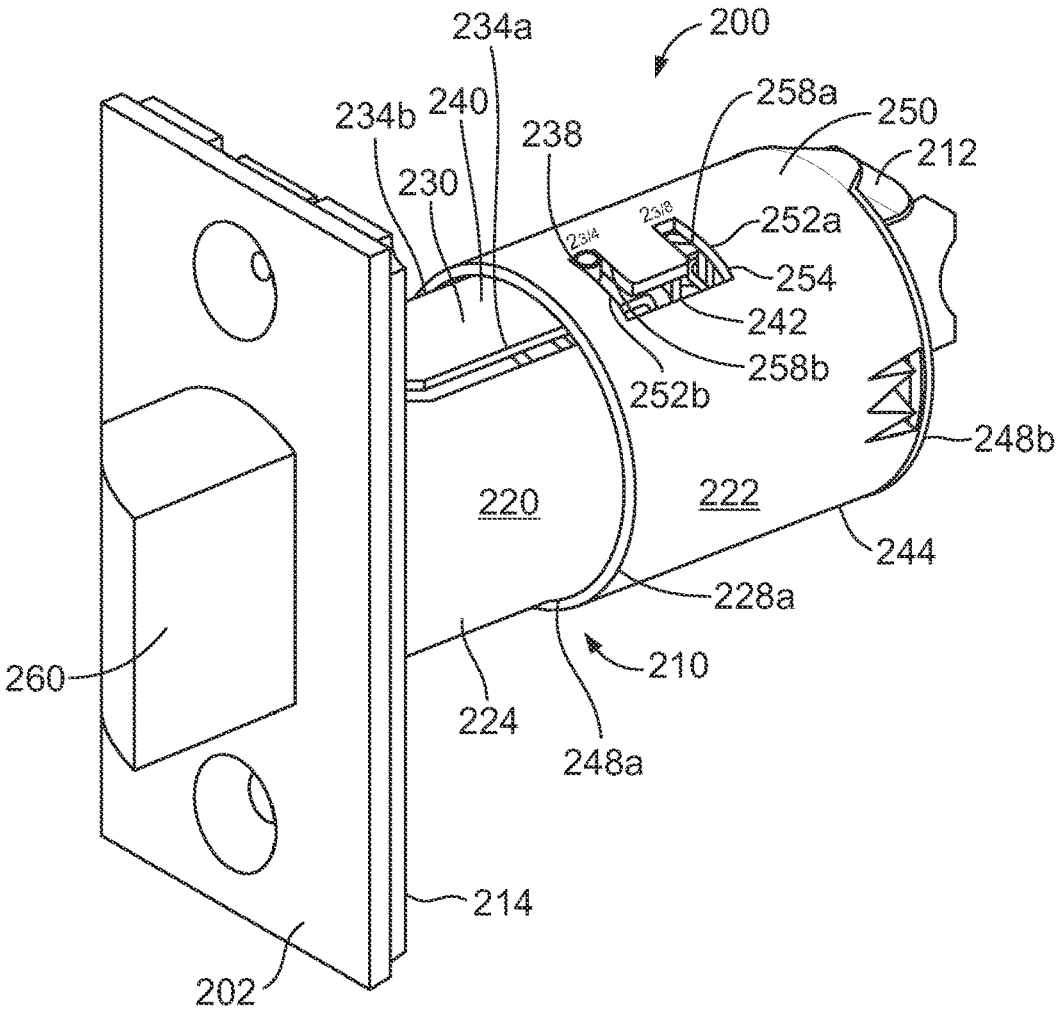
FIG. 2 illustrates a front side perspective view of an exemplary latch assembly according to an illustrated embodiment of the present invention.
Figure 3:
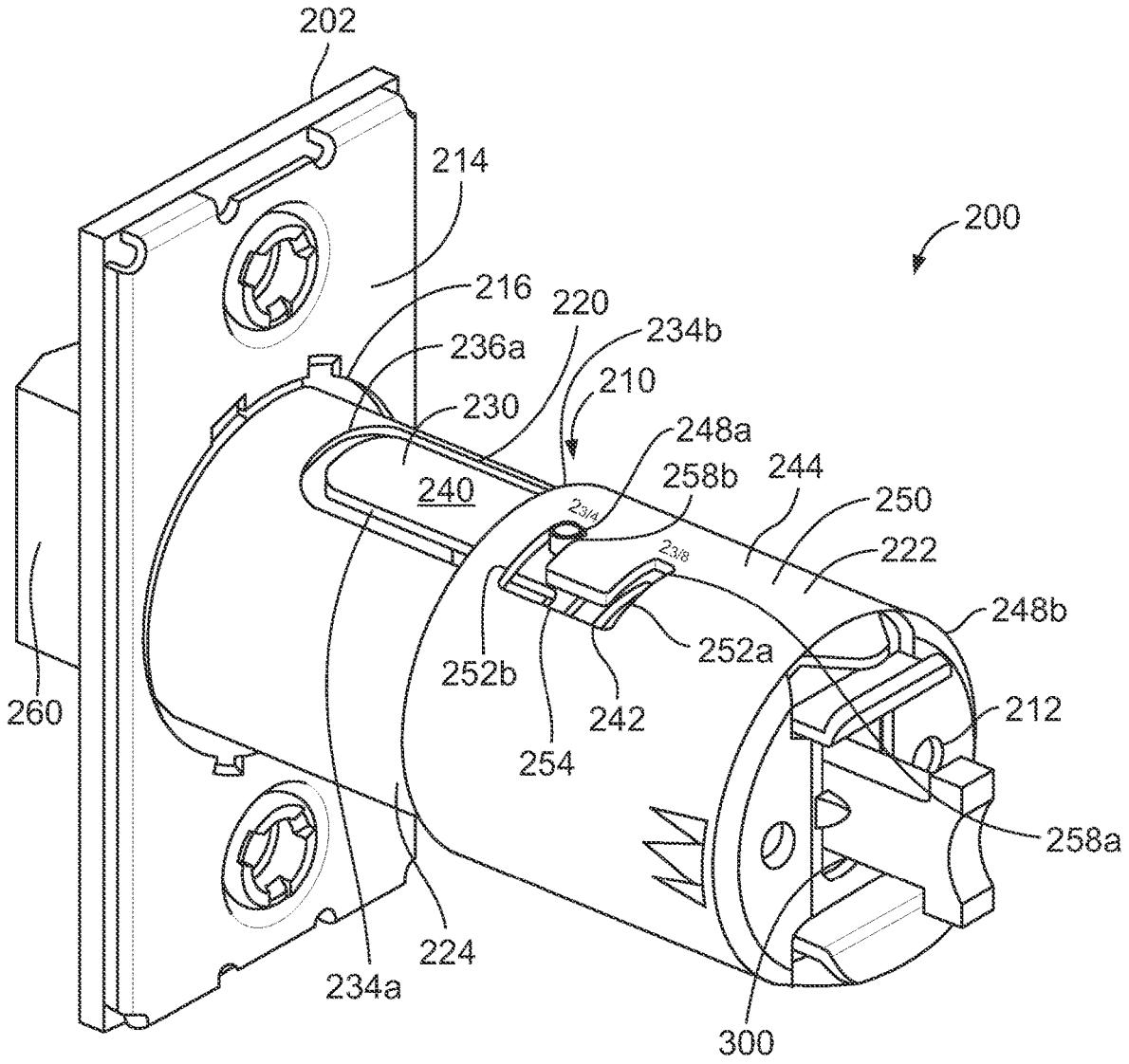
FIG. 3 illustrates a rear side perspective view of the latch assembly shown in FIG. 2.
Figure 4:
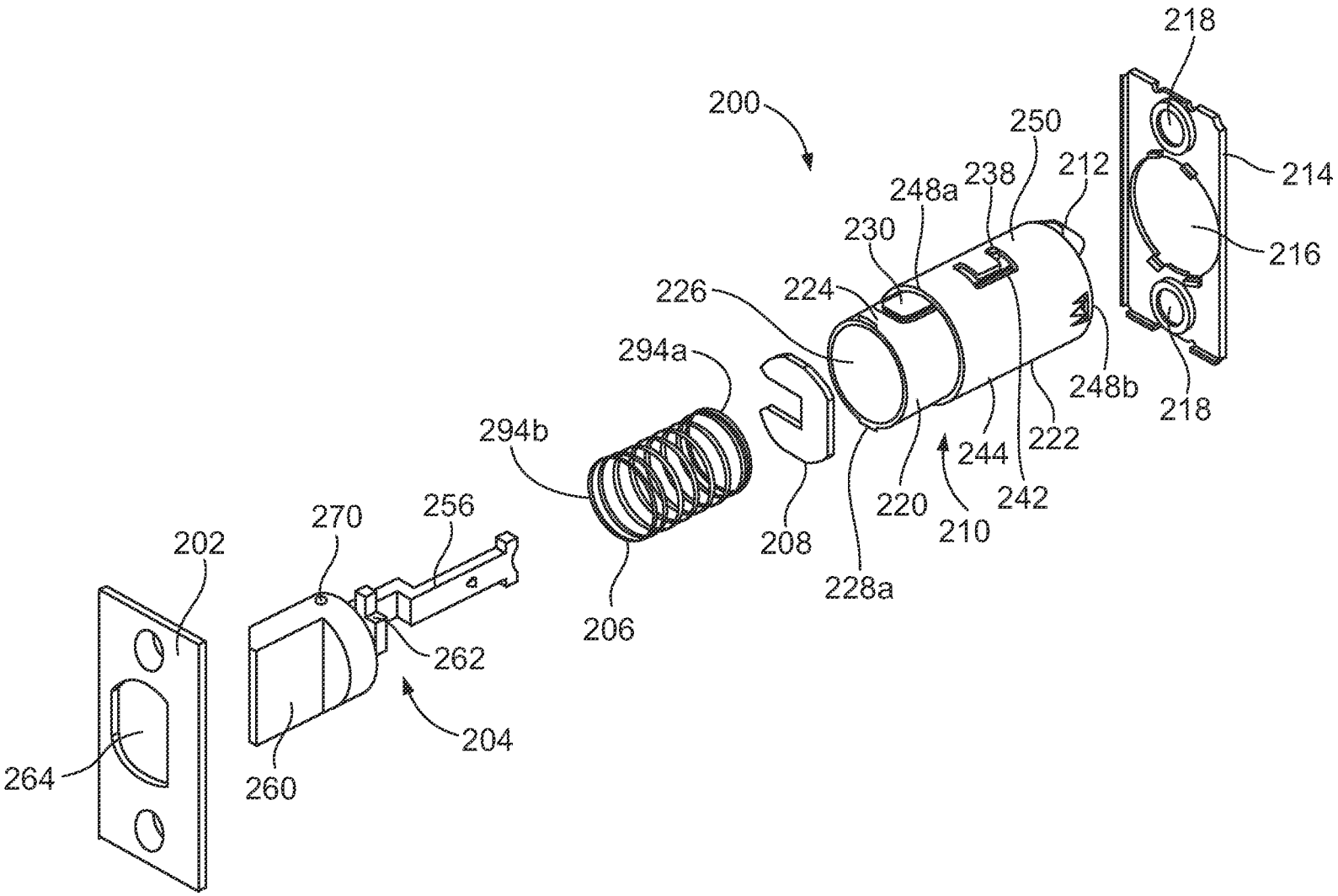
FIG. 4 illustrates an exploded perspective view of the latch assembly shown in FIG. 2.

FIGS. 2-4 illustrate a latch assembly 200 according to an illustrated embodiment of the present invention. The latch assembly 200 may include a face plate 202, a bolt assembly 204, a biasing element 206, one or more spacers or washers 208, a housing assembly 210, a hook plate 212, and a back plate 214. The back plate 214 may have an opening 216 that is sized to receive the slideable displacement of at least a portion of the bolt assembly 204. Additionally, according to certain embodiments, the opening 216 may be sized to receive the insertion of at least a portion of the housing assembly 210. The back plate 214 may also include one or more apertures 218 that are generally aligned with mounting holes in the door 100, and which are sized to receive a fastener, such as, for example, a screw. When the latch assembly 200 is secured to a door 100, the back plate 214 may abut the side edge 106 of the door 100 and/or be positioned within a recess 110 in the side edge 106.

The housing assembly 210 may include an inner housing 220 and an outer housing 222, as shown in at least FIGS. 4-7. The inner housing 220 includes an outer wall 224 that generally defines an inner region 226 of the inner housing 220. The outer wall 224 of the inner housing 220 may have a variety of different shapes and sizes. For example, in the illustrated embodiment, the outer wall 224 of the inner housing 220 has a generally cylindrical configuration. The inner region 226 of the inner housing 220 may be sized to receive placement of at least a portion of the spacer or washer 208, biasing element 206, and the bolt assembly 204. Further, opposing ends 228*a*, 228*b* of the inner region 226 may be sized to accommodate the slideable displacement of at least the inner housing 220 relative to at least a portion of the bolt assembly 204, or vice versa, as discussed in more detail below.

According to certain embodiments, the outer wall 224 of the inner housing 220 may include an engagement member 230 that may be displaced, deformed, pivoted and/or deflected from a first position to a second position. In the illustrated embodiment, a pivot end 232 of the engagement member 230 is attached to an adjacent portion of the outer wall 224, while the remainder of the engagement member 230 is detached from adjacent portions of the outer wall 224. More specifically, in the illustrated embodiment, the engagement member 230 has a generally square or rectangular configuration that comprises a first pair of opposing sidewalls 234*a*, 234*b* and a second pair of opposing end walls 236*a*, 236*b*, with one of the end walls 236*b* providing the pivot end 232 and the other end wall 236*a* and sidewalls 234*a*, 234*b* being detached from adjacent portions of the outer wall 224. However, the engagement member 230 may have a variety of other shapes and configurations. Additionally, while in the illustrated embodiment the pivot end 232 is a single, continuous portion or extension of the engagement member 230, according to other embodiments, the pivot end 232 may comprise one or more arms that provide pivot, deformation, deflection, or displacement points or portions of the engagement member 230 and/or of the outer wall 224. Additionally, the outer wall 224 may be constructed from a material, and/or have a wall thickness, that, when the engagement member 230 is subjected to a displacement force in the general direction of toward the inner region 226, may accommodate the displacement or deformation of the engagement member 230 from the first position to the second position, as well as the general return of engagement member from the second position to, or around, the first position upon removal of the displacement force.

The engagement member 230 further includes an engagement projection 238 that generally extends outwardly from an upper surface 240 of the engagement member 230. As discussed below in more detail, the engagement projection 238 is adapted to be receiving in an adjustment slot 242 of the outer housing 222. The engagement projection 238 may be positioned at a variety of locations along the engagement member 230. For example, according to the illustrated embodiment, as shown in at least FIG. 5, the engagement projection 238 may be positioned at or adjacent to the pivot end 232 of the engagement member 230.

The outer housing 222 has an outer housing wall 244 that generally defines an interior region 246 of the outer housing 222. The interior region 246 is configured to receive the insertion of at least a portion of the inner housing 220 through an opening in a first end 248*a* of the outer housing 222, as shown for example, by at least FIGS. 4, 6 and 7. The interior region 246 is further sized to receive placement of at least a portion of the hook plate 212. When the inner housing 220 is being positioned in the interior region 246, the engagement member 230 may be inwardly displaced, bent, or deformed from the first position to the second position such that the engagement projection 238 is positioned to not prevent at least a portion of the inner housing 220, including the engagement projection 238, from being inserted into the interior region 246 of the outer housing 222 to a location in which the engagement projection 238 is positioned to be received into the adjustment slot 242. Thus, upon reaching the adjustment slot 242, the displacement force exerted on the engagement member 230 may be removed so that the engagement member 230 may be displaced from the second position and to, or towards, the first position.

Further, the interior region 246 of the outer housing 222 is configured to accommodate at least both the partial rotational and axial displacement of the inner housing 220 relative to the interior region 246 of the outer housing 222. A second end 248*b* of the outer housing 222, and more specifically, the hook plate 212 at the second end 248*b*, is configured to receive the passage of at least a latch bar 256 of the latch assembly 200, as shown for example by at least FIGS. 3, 6, and 7.

The outer housing wall 244 further includes the adjustment slot 242. The adjustment slot 242 is adapted to receive the slideable displacement of the engagement projection 238 as the latch assembly 200 is adjusted between a first backset setting and a second backset setting. The adjustment slot 242 may have a variety of shapes and configurations. For example, according to the illustrated embodiment, the adjustment slot 242 may generally have a "U" shaped configuration about at least a top surface or upper region 250 of the outer housing wall 244. Moreover, according to the illustrated embodiment, the adjustment slot 242 may include opposing first and second transversal slots 252*a*, 252*b* and an axial slot 254 that may, or may not, interconnect the first and second transversal slots 252*a*, 252*b*.

Figure 5:
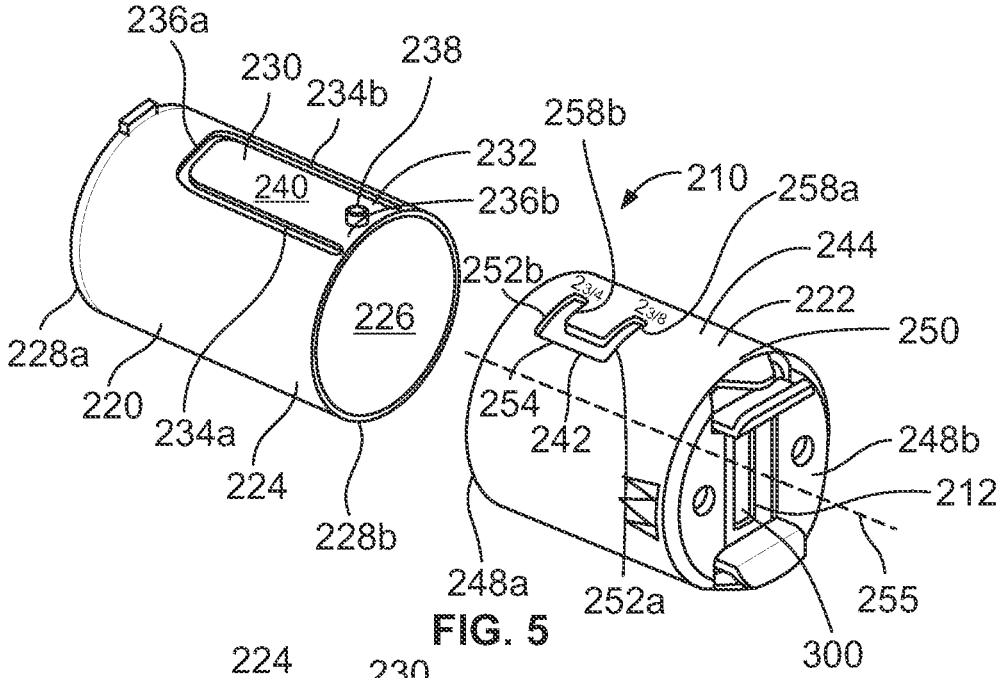
FIG. 5 illustrates an exploded perspective view of a housing assembly according to an illustrated embodiment of the present invention.

According to the illustrated embodiment, the engagement projection 238 may be positioned for the first backset setting when at least a portion of the engagement projection 238 is positioned at a first end 258*a* of the adjustment slot 242, and positioned for the second backset setting when at least a portion of the engagement projection 238 is at an opposite, second end 258*b* of the adjustment slot 242. Additionally, according to the illustrated embodiments, the first and second ends 258*a*, 258*b* may correspond to ends of the first and second transversal slots 252*a*, 252*b*, respectively, that are away from the location of the union or intersection of the first and second transversal slots 252*a*, 252*b* with the axial slot 254. According to certain embodiments, the axial slot 254 may extend in a direction that is be generally parallel to a longitudinal axis 255 of the outer housing 222, as shown in FIG. 5. Additionally, according to certain embodiments, the first and second transversal slots 252*a*, 252*b* may be generally perpendicular to the axial slot 254. Further, according to certain embodiments, the outer housing wall 244 may include indicia that correspond to a configuration of at least a portion of the latch assembly 200 for the first and/or second backset settings, respectively. For example, the indicia may provide an indication of the specific backset settings available for the latch assembly 200, such as, for example, the latch assembly 200 being configured for a first backset setting when the engagement projection 238 is at the first end 258*a* of the adjustment slot 242 or first transversal slot 252*a*, and at a second backset setting when the engagement projection 238 is at the second end 258*b* of the adjustment slot 242 or second transversal slot 252*ba*. Such indicia may be provided in a variety of different manners, including, for example, being an image, picture, or numerical representation, such as, for example, a representation corresponding to 2⅜ and 2¾ inches.

Figure 8:
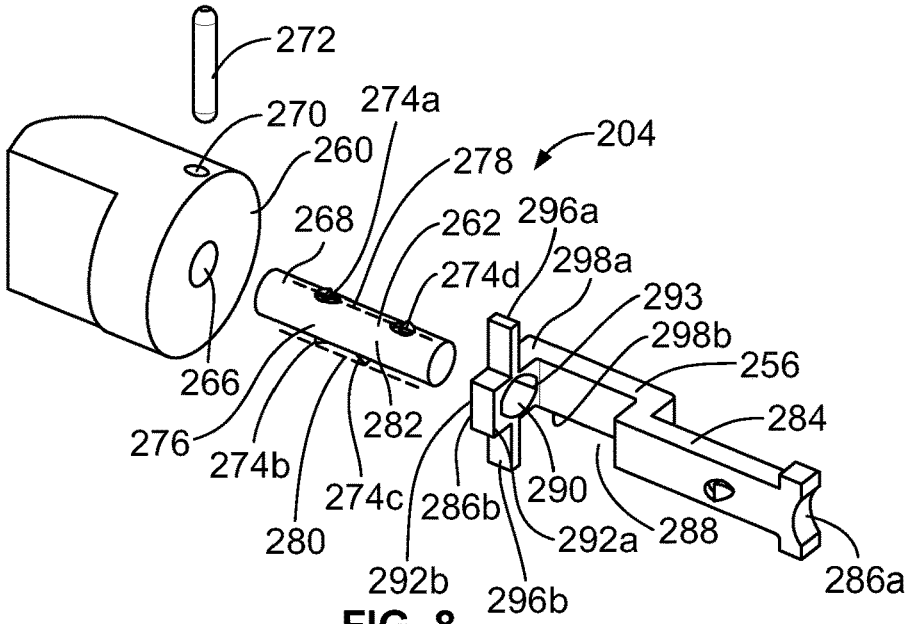
FIG. 8 illustrates an exploded view of an exemplary bolt assembly according to an illustrated embodiment of the present invention.
Figure 9:
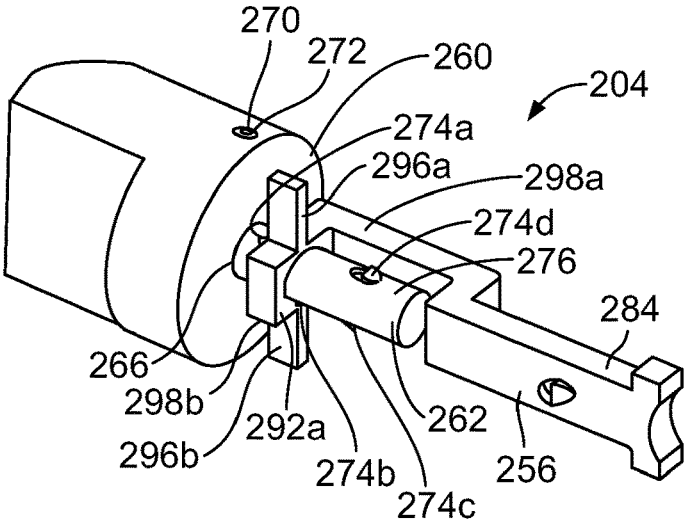
FIG. 9 illustrates a side perspective view of the bolt assembly shown in FIG. 8 oriented for a first backset setting.
Figure 10:
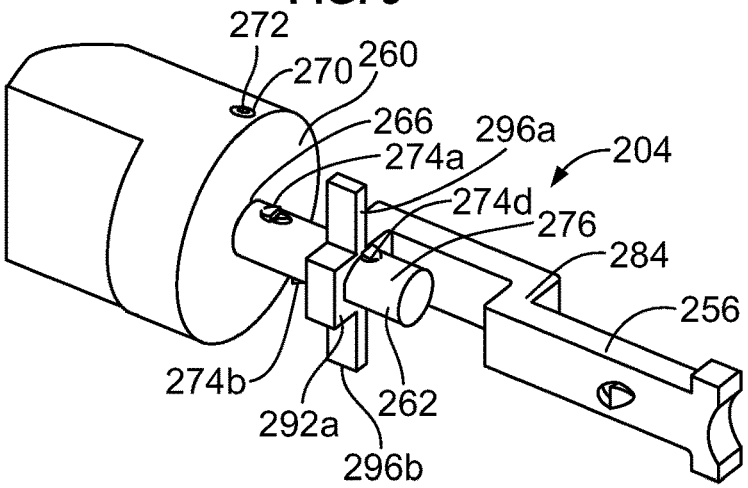
FIG. 10 illustrates a side perspective view of the bolt assembly shown in FIG. 8 oriented for a second backset setting.

FIGS. 8-10 illustrate an adjustable bolt assembly 204 according to an illustrated embodiment of the present invention. As shown, the illustrated bolt assembly 204 includes a latch bolt 260, a bolt rod 262, and a latch bar 256. The bolt assembly 204 is adapted to be axially displaced between an extended, locked position, and a retracted, unlocked position. When in the extended, locked position, and with the door 100 in a closed position, the bolt assembly 204 may be axially positioned so that the latch bolt 260 at least partially extends into an adjacent wall, door frame, and/or strike plate, among other structures, so as to at least attempt to prevent the door 100 from being displaced to an open position. When in the retracted, unlocked position, the bolt assembly 204 may be axially positioned, for example, such as being at least partially withdraw in or toward the door 100 so that the latch bolt 260 does not prevent the door 100 from being displaced from the closed position to an open position.

According to the illustrated embodiment, the face plate 202 and back plate 214 may include openings 264, 216 that are adapted to accommodate the axial displacement of at least a portion of the latch bolt 260. Further, according to the illustrated embodiment, the opening 264 of the face plate 202 may be configured to prevent rotational displacement of the latch bolt 260 about the opening 264. Moreover, to the extent that the latch bolt 260 and/or the face plate 202 is/are rotatably displaced, such as, for example, when adjusting the backset setting of the latch assembly 200, the latch bolt 260 may engage, or be engaged by, at least a portion of an edge or wall of the opening 264 of the face plate 202 so that the latch bolt 260 and the face plate 202 are generally rotatably displaced together. Further, the back plate 214 may be operably secured to the face plate 202, such as, for example, by a mechanical fastener, including a rivet, bolt, or screw, among other connectors, such that the back plate 214 may be rotatably displaced with the face plate 202.

The bolt rod 262 may be operably secured to the latch bolt 260 in a number of different manners. For example, according to the illustrated embodiment, the latch bolt 260 includes an orifice 266 that is sized to receive the insertion of at least a first end 268 of the bolt rod 262. Further, the latch bolt 260 may include an aperture 270 that is in fluid communication with the orifice 266. According to such an embodiment, a fastener 272, such as, for example, a set screw or pin, including a spring pin, may be positioned in the aperture 270 in a manner in which the fastener 272 exerts a force upon the bolt rod 262 so as to secure the bolt rod 262 within the orifice 266 of the latch bolt 260.

While the bolt rod 262 may have a variety of configurations, according to the illustrated embodiment, the bolt rod 262 is generally cylindrical in shape. Further, a plurality of retention projections 274*a-d* may extend from an outer surface 276 of the bolt rod 262 that are structured to adjustably engage the latch bar 256. Further, the retention projections 274*a-d* may be positioned along the bolt rod 262 at locations that may at least assist in the bolt assembly 204 being adjustable for different backset settings of the latch assembly 200, such as, for example, the first backset setting and the second backset setting. According to the illustrated embodiment, a first pair of retention projections 274*a*, 274*b* may be utilized to retain the latch bar 256 at a first position that is associated with the first backset setting, and a second pair of retention projections 274*c*, 274*d* may be utilized to retain the latch bar 256 at a second position that is associated with the second backset setting. Further, as shown at least in FIG. 8, according to the illustrated embodiment, one retention projection 274*a*, 274*d* of the first and second pairs of retention pins may be positioned along a first retention axis 278, while the other retention projection 274*b*, 274*c* of the first and second pairs of retention pins is positioned along a second retention axis 280. As discussed below, such positioning may provide slots or spaces 282 between the retention projections 274*a-d* that at least assist in facilitating adjustment of the axial position of the bolt rod 262 relative to at least the latch bar 256.

The latch bar 256 includes an outer wall 284 that extends between first and second ends 286*a*, 286*b* of the latch bar 256. Further, the latch bar 256 is configured to be positioned within the latch hole 108 in a manner that allows at least the first end 286*a* of the latch bar 256 to extend into the cylindrical hole or opening 102. Additionally, the first end 286*a* of the latch bar 256 may be adapted to engage a portion of a lock chassis that is at least partially positioned within the cylindrical hole or opening 104, such as, for example, a slide assembly. The latch bar 256 further includes a cavity 288 that is adapted to receive the adjustable or selective placement of at least a portion of the bolt rod 262, as shown in at least FIGS. 9 and 10. Moreover, the portion of the bolt rod 262 that is positioned in the cavity 288 may be different when the bolt assembly 204 is oriented to accommodate the first or second backset setting. According to the illustrated embodiment, the cavity 288 may be in fluid communication with an aperture 290 that extends between a portion of the inner and outer sides 292*a*, 292*b* of the outer wall 284 of the latch bar 256. According to certain embodiments, the aperture 290 may include one or more grooves 293 that are sized to accommodate passage of at least a portion of the retention projections 274*a-d* as the bolt assembly 204 is adjusted to be oriented for the first and second backset settings. However, the aperture 292 may have a variety of other shapes and sizes that are adapted to accommodate the passage of the bolt rod 262, including the passage of one or more of the retention projections 274*a-d* through the aperture 290. For example, according to certain embodiments, the aperture 290 may have an oval shape, with one or more of the retention projections 274*a-d* sized to pass through at least one elongated end of the oval-shaped aperture 290. Additionally, as indicated by at least FIGS. 9 and 10, when the bolt rod 262 is operably engaged with the latch bar 256, at least one retention projection 274*b*, 274*d* of the first or second pairs of retention projections 274*a-d* may be positioned to abut the inner side 292*a* of the outer wall 284, while the other, corresponding retention projection 274*a*, 274*c* of the first or second pair of retention projections 274*a-d* is positioned to abut an outer side 292*b* of the outer wall 284.

Figure 11:
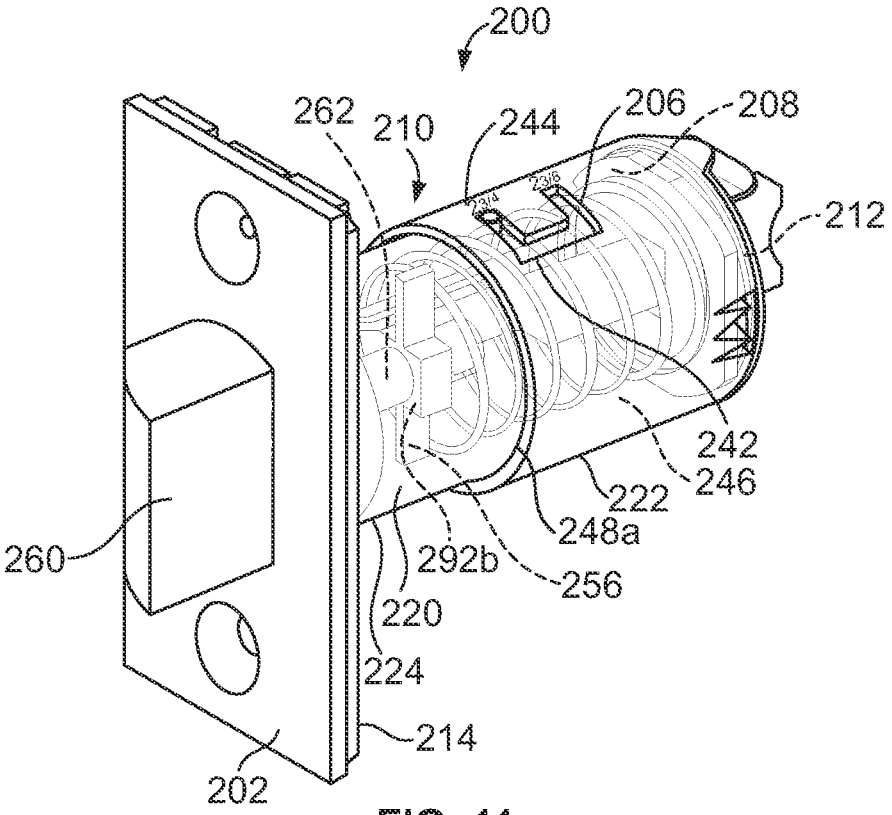
FIG. 11 illustrates a perspective partial shadow view of the latch assembly shown in FIG. 4.
Figure 12:
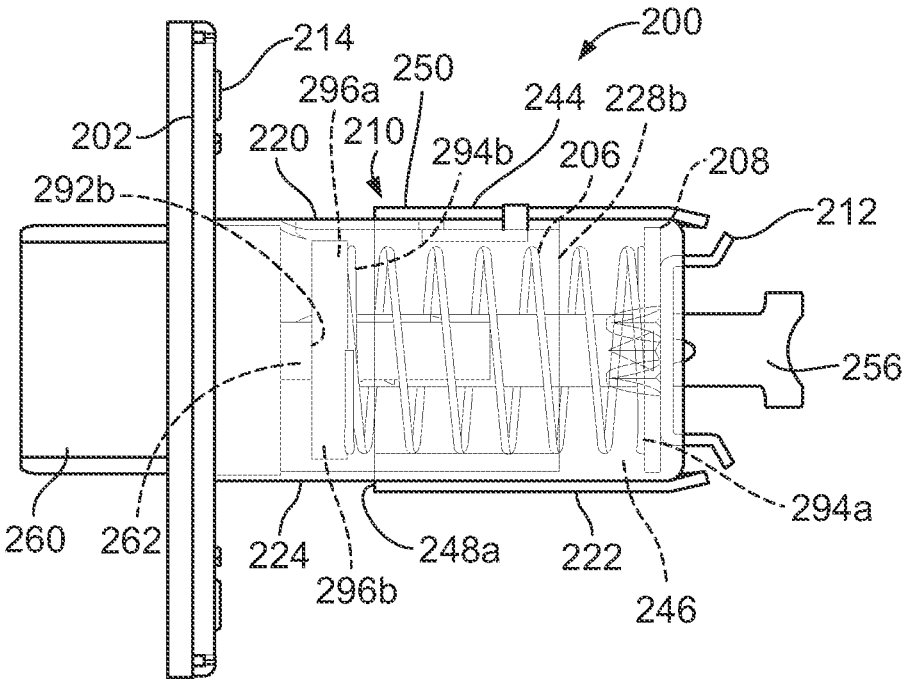
FIG. 12 illustrates a side partial shadow view of the latch assembly shown in FIG. 4.

Referencing FIGS. 11 and 12, the biasing element 206 may be positioned to bias the bolt assembly 204 toward the extended, locked position. According to the illustrated embodiment, the biasing element 206 may be a spring, such as, for example, a coil spring, having a first end 294*a* and a second end 294*b*. The first end 294*a* of the biasing element 206 may abut against the spacer or washer 208 or at least portion of the housing assembly 210. The second end 294*b* of the biasing element 206 may abut against the second end 286*b* of the latch bar 256, such as, for example, against one or more projections 296*a*, 296*b* that extend from upper and lower sides 298*a*, 298*b* of the outer wall 284 at the first end 286*a* of the latch bar 256. According to such an arrangement, the biasing force provided by the biasing element 206 may remain relatively constant regardless of whether the latch assembly 200 is at the first or second backset settings.

The hook plate 212 may be operably secured to the second end 248*b* of the outer housing 222, such as, for example, being secured within the interior region 246 of the outer housing 222 by lancing. The hook plate 212 includes an opening 300 that is sized to receive the slideable displacement of at least a portion of the latch bar 256. However, the opening 300 may also be configured to prevent rotational displacement of the latch bar 256 relative to the outer housing 222. For example, according to the illustrated embodiment, the outer wall 284 at least at the second end 286*b* of the latch bar 256 may have a generally rectangular shaped cross section that is similar to the rectangular shaped cross section of the opening 300 of the hook plate 212. According to such an embodiment, the opening 300 may be sized to prevent or minimize rotational displacement of the latch bar 256 within the opening 300.

Figure 6:
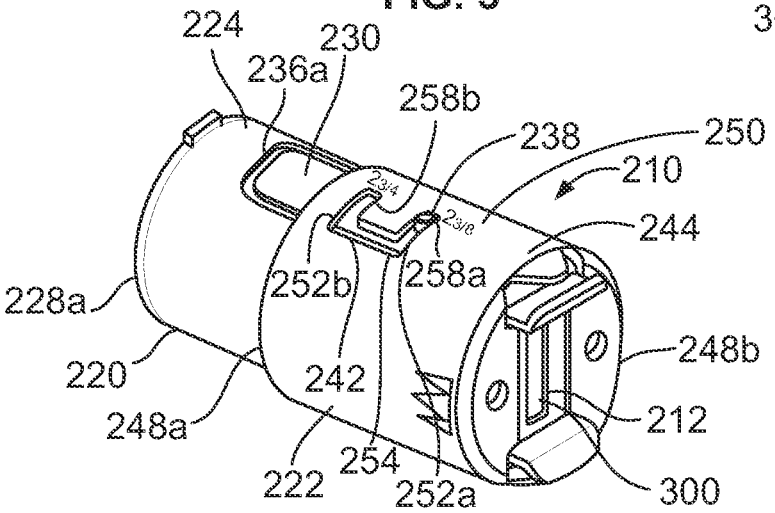
FIG. 6 illustrates a side perspective view of the housing assembly shown in FIG. 5 in a first backset position.

When the latch assembly 200 is at the first backset setting, such as being configured for a 2⅜ inch backset setting, the engagement projection 238 of the engagement member 230 of the inner housing 220 may be at the first end 258*a* of the adjustment slot 242, as shown in FIG. 6, and the bolt rod 262 may be at a first position relative to the latch bar 256, as shown, for example, in FIG. 9. Further, with the bolt rod 262 in the first position, first and second retention projections 274*a*, 274*b* of the first pair of retention projections may abut corresponding, opposing inner and outer sides 292*a*, 292*b* of the outer wall 284 of the latch bar 256.

According to certain embodiments, the inner housing 220 may be secured to the back plate 214 and/or face plate 202 such that axial and/or rotational displacement of the inner housing 220 relative to the outer housing 222 may translate into similar displacement of at least the latch bolt 260 and bolt rod 262 relative to the latch bar 256, or vice versa. For example, when adjusting the latch assembly 200 from the first backset setting to the second backset setting, such as, for example, from a 2⅜ inch backset setting to a backset setting of 2¾ inches, the face plate 202, back plate 214, latch bolt 260, bolt rod 262, and inner housing 220 may be rotatably displaced relative to the outer housing 222 and latch bar 256, or vice versa. For example, according to the illustrated embodiment, the inner housing 220 may be rotatably displaced relative to at least the outer housing 222 in a first direction such that the engagement projection 238 is generally displaced away from the first end 258*a* of the adjustment slot 242 along the first transversal slot 252*a* until the engagement projection 238 is positioned along the axial slot 254 of the adjustment slot 242. Such rotational displacement of the inner housing 220 relative to the outer housing 222 may coincide with the rotational displacement of the face plate 202 and/or back plate 214, and thus latch bolt 260 and bolt rod 262, relative to at least the latch bar 256. As previously discussed, such displacement of at least the bolt rod 262 may cause at least one of the retention projections 274*a*, 274*b* of the first pair of retention projections and at least one retention projection 274*c*, 274*d* of the second pair of retention projections to be moved into position to pass through one or more grooves 293 in the aperture 290 of the latch bolt 260, or, alternatively, be positioned to pass through at least one elongated end of an oval-shaped aperture 290. Further, according to certain embodiments, the distance that the engagement projection 238 is rotatably displaced relative to the outer housing 222 from the first end 258*a* of the adjustment slot 242 to the axial slot 254 may correspond to the distance that the retention projections 274*a-d* are rotatably displaced relative to the latch bar 256 so that one or more of the retention projections 274*a-d* are positioned to pass through the aperture 290 of the latch bar 256.

Figure 7:
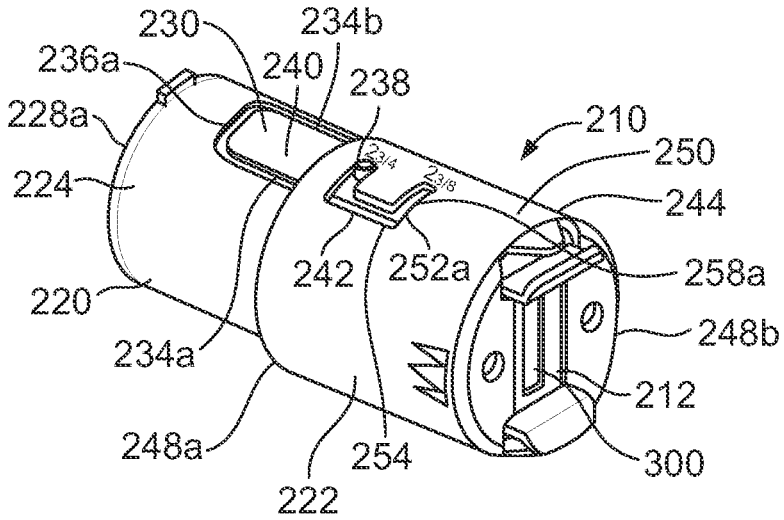
FIG. 7 illustrates a side perspective view of the housing assembly shown in FIG. 5 in a second backset position.

With the engagement projection 238 positioned adjacent to the axial slot 254 of the adjustment slot 242, and with one or more of the retention projections 274*a-d* of the first and second pairs of retention projections positioned to pass through the aperture 290 of the latch bar 256, the inner housing 220 may be axially displaced relative to the outer housing 222 such that the engagement projection 238 is axially displaced along the axial slot 254 until the engagement projection 238 reaches the second transversal slot 252*b* of the adjustment slot 242. Similarly, such relative axial displacement of the inner housing 220 may coincide with at least the bolt rod 262 being axially displaced relative to the latch bar 256 until the second pair of retention projections 274*c*, 274*d* are at an axial position to, when the bolt rod 262 is rotatably displaced relative to the latch bar 256, engage the corresponding, adjacent inner and outer sides 292*a*, 292*b* of the outer wall 284 of the latch bar 256. The inner housing 220 may then be rotatably displaced in a second direction such that the engagement projection 238 travels along the second transverse edge 252*b* of the adjustment slot 242 until reaching the second end 258*b* of the adjustment slot 242, as shown in FIG. 7. Similarly, such relative rotational displacement of the inner housing 220 may be associated with the face and/or back plates 202, 214, as well as the latch bolt 260 and bolt rod 262, being rotated in the second direction. Further, the bolt rod 262 may be configured such that, when the engagement projection 238 is at the second end 248*b* of the adjustment slot 242, and thus at a second backset setting, the retention projections 274*c*, 274*d* of the second pair of retention projections are positioned adjacent to the associated inner and outer sides 292*a*, 292*b* of the outer wall 284 of the latch bar 256 such that the bolt rod 262 and latch bolt 260 are secured for the second backset setting, as shown for example in FIG. 10.

The latch assembly 200 may also be adjusted from the second backset setting to the first backset setting in a similar, but reverse, manner to/of the above discussed example for adjustment from the first to a second backset setting. For example, the inner housing 220 may be rotatably displaced relative to at least the outer housing 222 in the first direction such that the engagement projection 238 is generally displaced from the second end 258*b* of the adjustment slot 242 along the second transversal slot 252*b* of the adjustment slot 242 until the engagement projection 238 is positioned along the axial slot 254 of the adjustment slot 242. Such rotational displacement may also coincide with the rotational displacement of the bolt rod 262 such that at least one engagement projection 238 of the first and second pairs of retention projections is positioned for passage through the aperture 290 in the latch bar 256. The inner housing 220 may then be axially displaced relative to the outer housing 222 until the engagement projection 238 reaches the first transversal slot 252*a*. Again, the bolt rod 262 may be configured such that, when the engagement projection 238 reaches the first transversal slot 252*a*, the first pair of retention projections 274*a*, 274*b* are at an axial location such that, upon relative rotational displacement of the bolt rod 262, the retention projections 274*a*, 274*b* may abut or otherwise be adjacent to the corresponding inner and outer sides 292*a*, 292*b* of the outer wall 284 of the latch bar 256. The inner housing 220 may then be rotated in a second direction, such that the engagement projection travels along the first transversal slot 252*a* of the adjustment slot 242 to the first end 258*a* of the adjustment slot 242, as shown in FIG. 7, while the bolt rod 262 is at its first position, as shown in FIG. 9.

FIGS. 13A-20 illustrate a latch assembly 400 according to another illustrated embodiment of the present invention. The latch assembly 400 may include a face plate 402, a bolt assembly 404, a biasing element 406, one or more spacers or washers 408, a housing assembly 410, a hook plate 412, and a back plate 414. The back plate 414 may have an opening 416 that is sized to receive the slideable displacement of at least a portion of the bolt assembly 404. Additionally, according to certain embodiments, the opening 416 may be sized to receive the insertion of at least a portion of the housing assembly 410. The back plate 414 may also include one or more apertures 418 that are generally aligned with mounting holes in the door 100 and which are sized to receive a fastener, such as, for example, a screw. When the latch assembly 400 is secured to a door 100, the back plate 414 may abut the side edge 106 of the door 100 and/or be positioned within a recess 110 in the side edge 106.

The housing assembly 410 may include an inner housing 420 and an outer housing 422, as shown in at least FIGS. 15, 16A-B, and 17. The inner housing 420 includes an outer wall 424 that generally defines an inner region 426 of the inner housing 420. The outer wall 424 of the inner housing 420 may have a variety of different shapes and sizes. For example, in the illustrated embodiment, the outer wall 424 of the inner housing 420 has a generally cylindrical configuration. The inner region 426 of the inner housing 420 may be sized to receive placement of at least a portion of the spacer or washer 408, biasing element 406, and the bolt assembly 404. Further, opposing ends 428*a*, 428*b* of the inner region 426 may be sized to accommodate the slideable displacement of at least the inner housing 420 relative to at least a portion of the bolt assembly 404, or vice versa, as discussed in more detail below.

According to certain embodiments, the outer wall 424 may include an engagement member 430 that maybe displaced, deformed, pivoted and/or deflected from a first position to a second position, as discussed below. In the illustrated embodiment, a pivot end 432 of the engagement member 430 is attached to an adjacent portion of the outer wall 424, while the remainder of the engagement member 430 is detached from adjacent portions of the outer wall 424. More specifically, in the illustrated embodiment, the engagement member 430 has a generally square or rectangular configuration that comprises a first pair of opposing sidewalls 434*a*, 434*b* and a second pair of opposing end walls 436*a*, 436*b*, with one of the end walls 436*b* providing the pivot end 432 and the other end wall 436*a* and the sidewalls 434*a*, 434*b* being detached from adjacent portions of the outer wall 424. However, the engagement member 430 may have a variety of other shapes and configurations. Additionally, while in the illustrated embodiment the pivot end 432 is a single, continuous portion or extension of the engagement member 430, according to other embodiments, the pivot end 432 may comprise one or more arms that provide pivot, deformation, deflection, or displacement points or portions of the engagement member 430 and/or of the outer wall 424. Additionally, the outer wall 424 may be constructed from a material, and/or have a wall thickness, that, when the engagement member 430 is subjected to a displacement force in the general direction of the interior region 426, may accommodate the displacement or deformation of the engagement member 430 from the first position to the second position, as well as the general return of engagement member from the second position to the first position upon removal of the displacement force.

The engagement member 430 further includes an engagement projection 438 that generally extends outwardly from an upper surface 440 of the engagement member 430. As discussed below in more detail, the engagement projection 438 is adapted to be receiving in an adjustment slot 442 of the outer housing 422. The engagement projection 438 may be positioned at a variety of locations along the engagement member 430.

The outer housing 422 has an outer housing wall 444 that generally defines an interior region 446 of the outer housing 422. The interior region 446 is configured to receive the insertion of at least a portion of the inner housing 420 through an opening in a first end 448*a* of the outer housing 422, as illustrated, for example, by at least FIGS. 13A-B, 16A-B, 19, and 20. The interior region 446 is further sized to receive placement of at least a portion of the hook plate 412. When the inner housing 420 is being positioned in the interior region 446, the engagement member 430 may be inwardly displaced, bent, or deformed from the first position to the second position such that the engagement projection 438 is positioned to not prevent the inner housing 420 from being positioned within the interior region 446. Moreover, such displacement of the engagement member 430 may allow the engagement projection 428 to be displaced within the interior region 448 to a location at which the engagement projection 438 is positioned to be received into the adjustment slot 442. Upon reaching the adjustment slot 442, the displacement force on the engagement member 430 may at least be partially removed or reduced, and the engagement member 430 may be displaced from the second position and to, or around, the first position.

The interior region 446 is also configured to accommodate at least both the partial rotational and axial displacement of the inner housing 420 within the interior region 446 of the outer housing 422. Additionally, a second end 448*b* of the outer housing 422 is configured to receive the passage of at least a latch bar 450 through the second end 448*b* of the outer housing 422, and more specifically through the hook plate 412 at the second end 448*b*, as shown for example by at least FIGS. 13A-B, 19, and 20.

The outer housing wall 444 further includes the adjustment slot 442. The adjustment slot 442 is adapted to receive the slideable displacement of the engagement projection 438 between a first backset setting and a second backset setting. The adjustment slot 442 may have a variety of shapes and configurations. For example, according to the illustrated embodiment, the adjustment slot 442 may have a generally partial spiral or helical orientation such that the adjustment slot 442 extends both radially and axially about at least a portion of the outer housing wall 444. According to such an embodiment, the axial distance the adjustment slot 442 extends along the outer housing wall 444 may correspond to the latch assembly 400 being at the predetermined first or second backset setting.

Figure 13A:
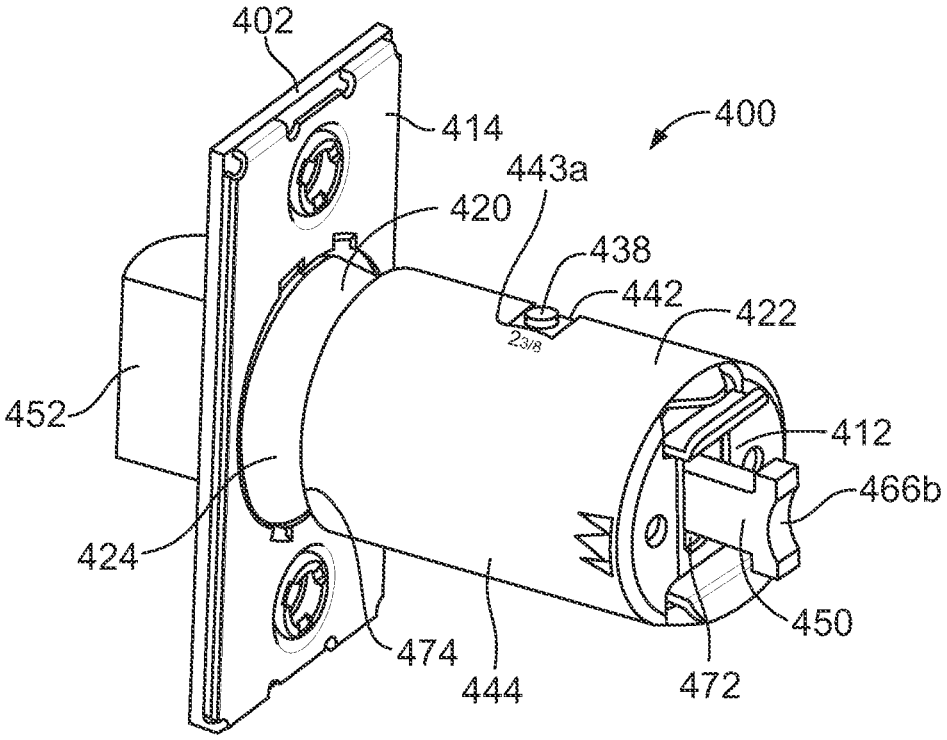
FIGS. 13A and 13B illustrate rear side perspective views of a latch assembly at first and second backset settings, respectively, according to another embodiment of the present invention.
Figure 13B:
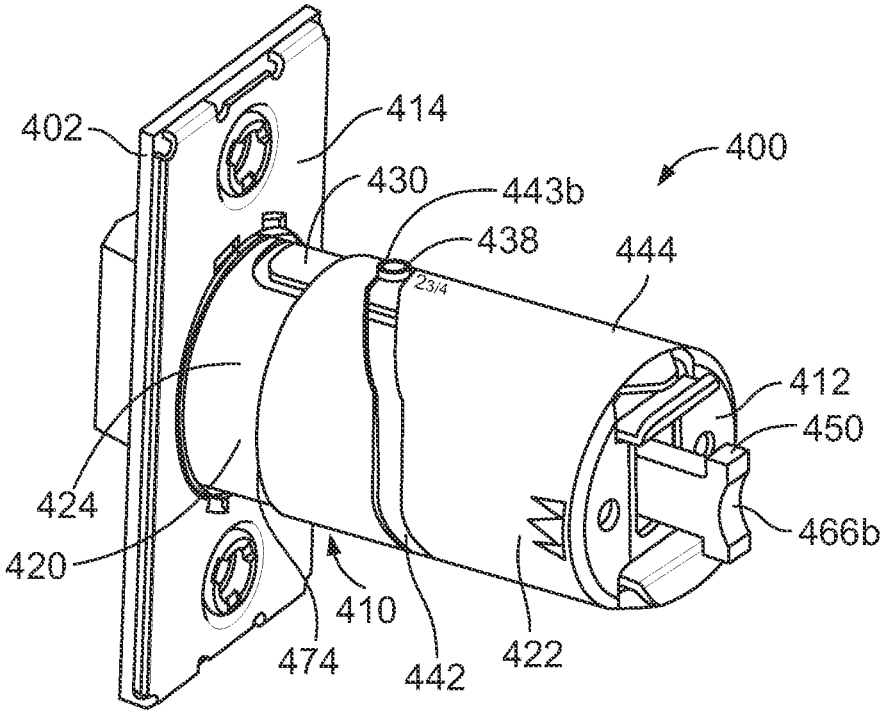
Figure 14:
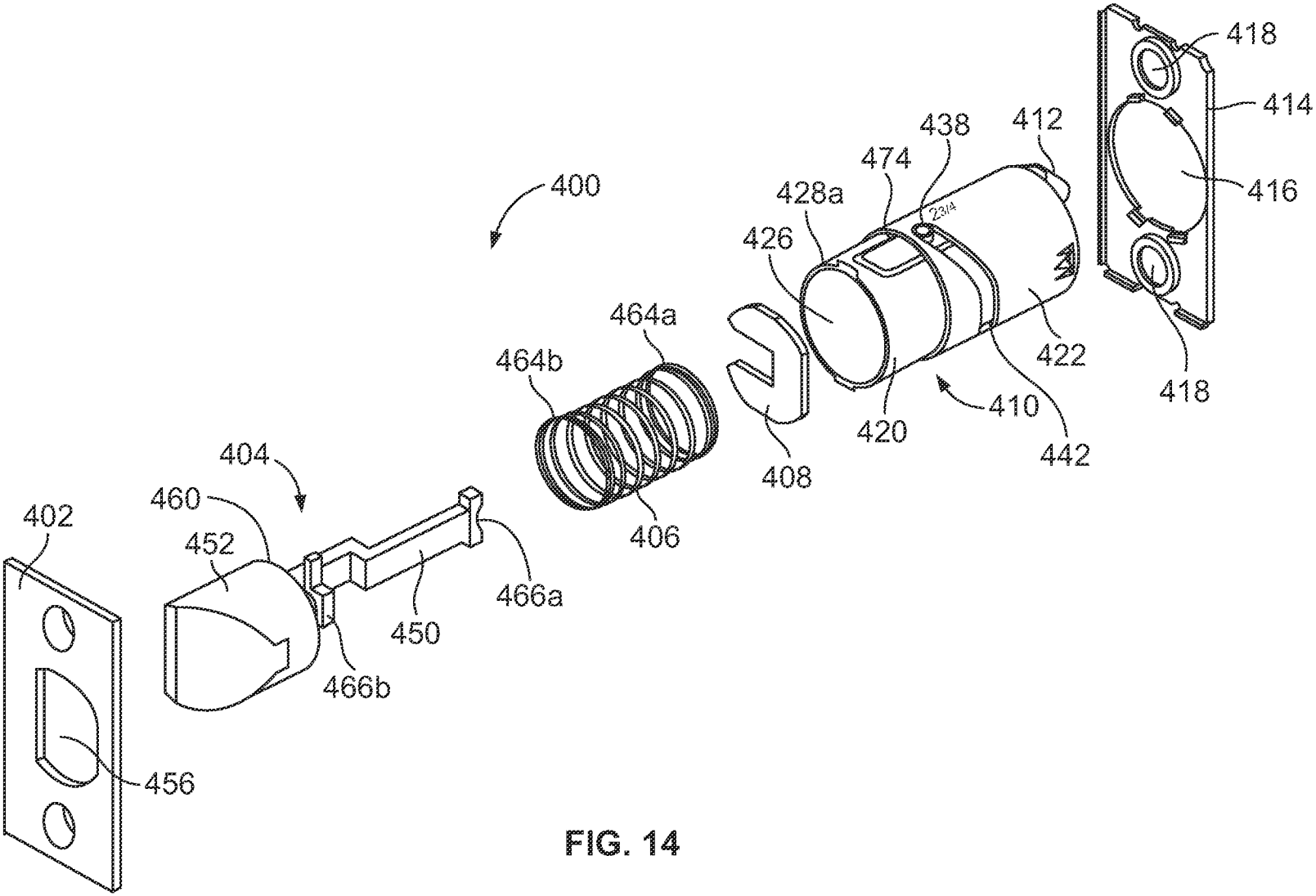
FIG. 14 illustrates an exploded perspective view of the latch assembly shown in FIGS. 13A-B.
Figure 15:
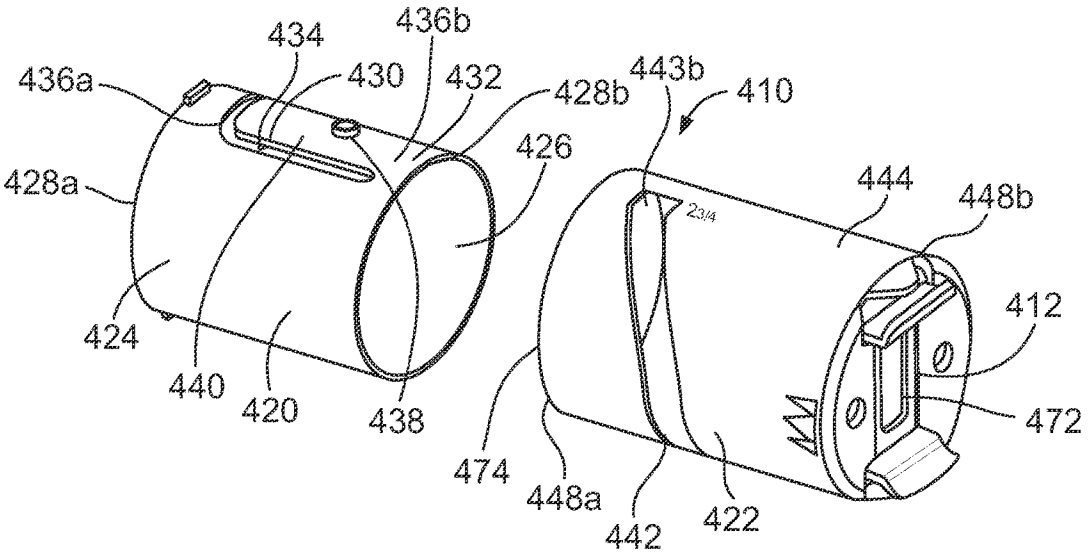
FIG. 15 illustrates an exploded perspective view of a housing assembly according to an illustrated embodiment of the present invention.
Figure 16B:
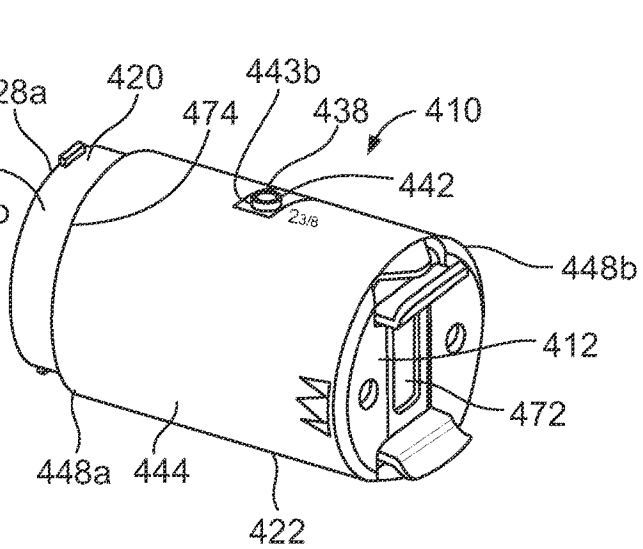
FIGS. 16A-B illustrate side perspective views of the housing assembly shown in FIG. 5 oriented for a first backset position and a second backset position, respectively.
Figure 16A:
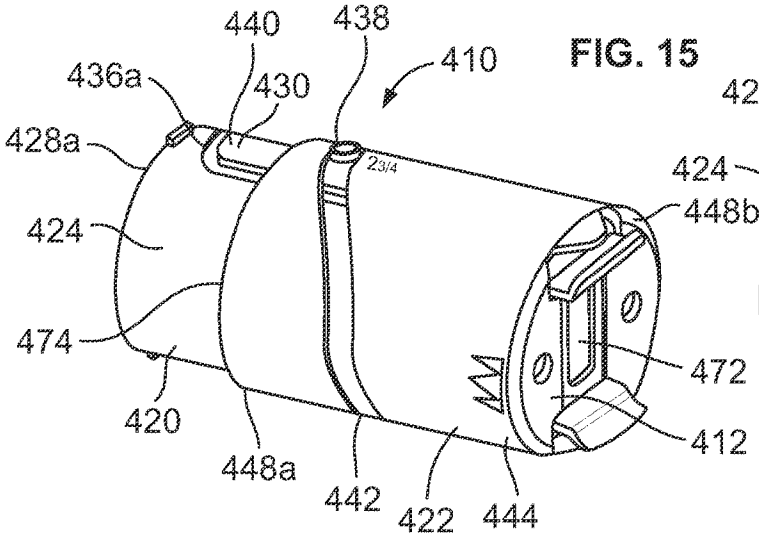
Figure 19:
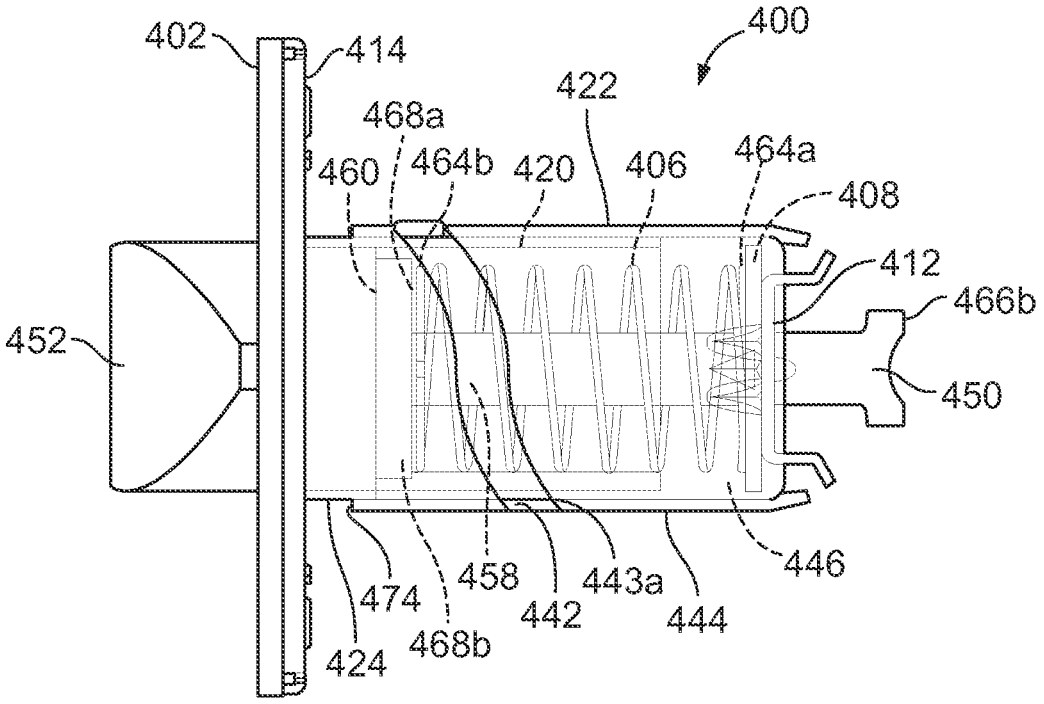
FIG. 19 illustrates a side partial shadow view of the latch assembly shown in FIG. 13A at a first backset setting.

When the engagement projection 438 is at a first end 443*a* of the adjustment slot 442, as shown by at least FIGS. 13A and 19, the latch assembly 400 may be configured or oriented for the first backset setting, such as, for example, a backset setting of 2⅜ inches. Conversely, when the engagement projection is at a second end 443*b* of the adjustment slot 442, as shown by at least FIGS. 13B and 20, the latch assembly 400 may be configured or oriented for the second backset setting, such as, for example, a backset setting of 2¾ inches. Additionally, according to certain embodiments, the outer housing wall 444 may also include indicia that correspond to a configuration of at least a portion of the latch assembly 400, such as an indication of when the engagement projection 438 positioned for the first or second backset settings. Such indicia may be provided in a variety of different manners, including, for example, being an image, picture, or numerical representation, such as, for example, representations corresponding to 2⅜ inches and 2¾ inches.

Figure 17:
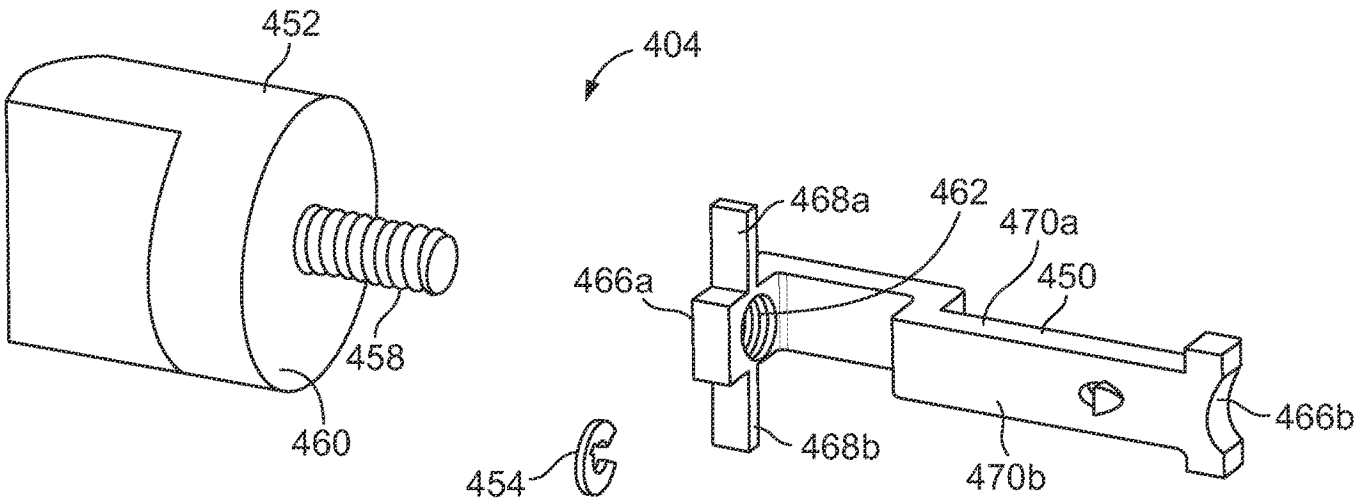
FIG. 17 illustrates an exploded view of an exemplary bolt assembly according to an illustrated embodiment of the present invention.
Figure 18:
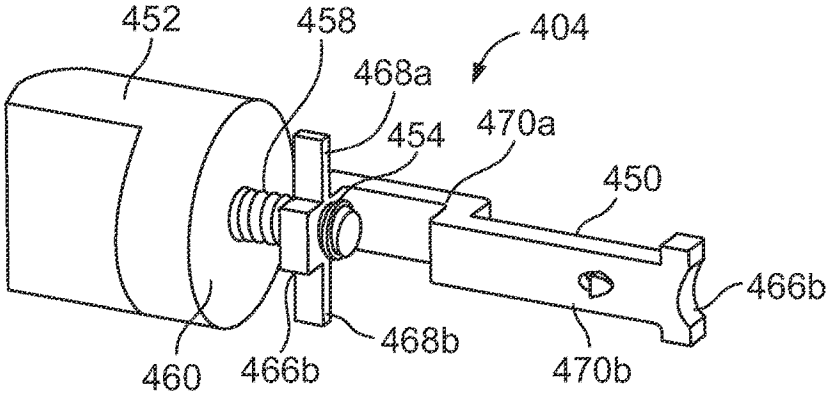
FIG. 18 illustrates a side perspective view of the bolt assembly shown in FIG. 17 oriented for a first backset setting.

FIGS. 17 and 18 illustrate an adjustable bolt assembly 404 according to an illustrated embodiment of the present invention. As shown, the illustrated bolt assembly 404 includes a latch bolt 452, a latch bar 450, and a retaining clip 454. The bolt assembly 404 is adapted to be axially displaced between an extended, locked position, and a retracted, unlocked position. When in the extended, locked position, and with the door 100 in a closed position, the bolt assembly 404 may be axially displaced so that the latch bolt 452 may at least partially extend into an adjacent wall, door frame, and/or strike plate, among other structures, so as to at least attempt to prevent the door 100 from being displaced to an open position. When in the retracted, unlocked position, the bolt assembly 404 may be axially withdrawn toward the door 100 so that the latch bolt 452 is not positioned to prevent the door 100 from being displaced from the closed position to an open position.

According to the illustrated embodiment, the face plate 402 and back plate 414 may include openings 456, 416 that are adapted to accommodate the axial displacement of at least a portion of the latch bolt 452. Further, according to the illustrated embodiment, the opening 456 of the face plate 402 may be configured to prevent rotational displacement of the latch bolt 452 about the opening 456. Moreover, to the extent that the latch bolt 452 and/or face plate is/are rotatably displaced, such as, for example, when adjusting the backset setting of the latch assembly 400, the latch bolt 452 may engage at least a portion of the edge or wall of the opening 456 of the face plate 402 so that the latch bolt 452 is generally rotatably displaced with the face plate 402. Further, the back plate 414 may be operably secured to the face plate 402, such as, for example, by a mechanical fastener, including a rivet, bolt, or screw, among other connectors, such that the back plate 414 may be rotatably displaced with the face plate 402.

Figure 20:
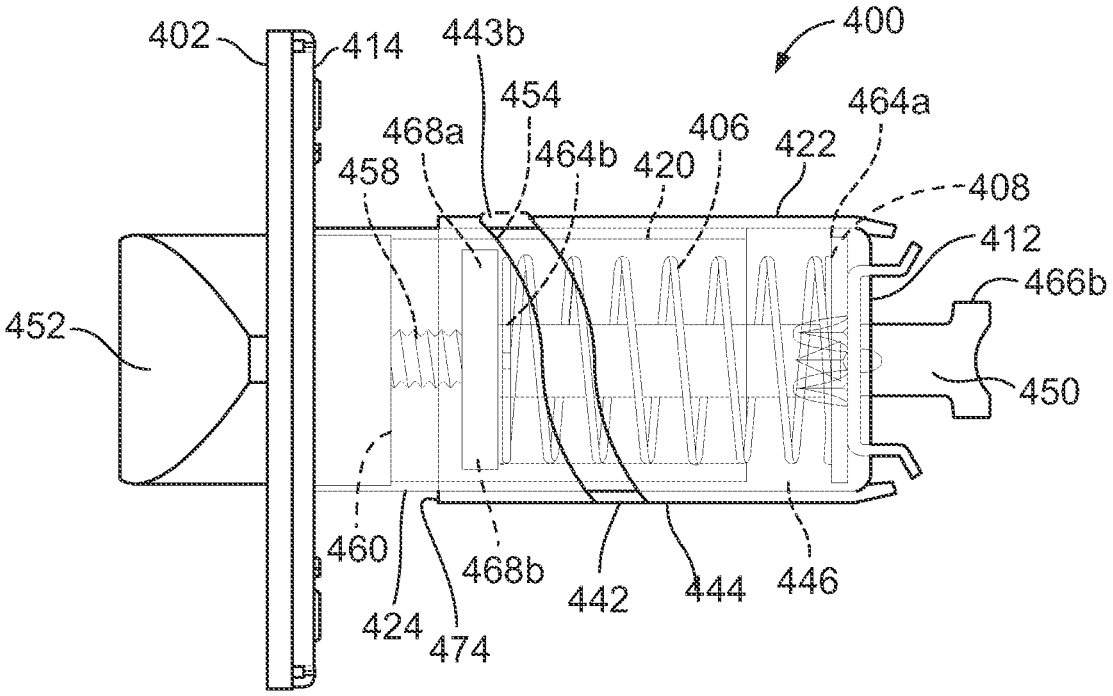
FIG. 20 illustrates a side partial shadow view of the latch assembly shown in FIG. 13B at a second backset setting.

The latch bolt 452 may include a retention rod 458 that extends from a rear side 460 of the latch bolt 452. The retention rod 458 may be adapted to securely engage the latch bolt 452. For example, according to the illustrated embodiment, the retention rod 458 may have an external thread that mates an internal thread of an aperture 462 of the latch bar 450. Further, the external thread of the retention rod 458 may be configured such that the axial position of the latch bar 450 relative to at least the latch bolt 452 may be adjusted by the rotational displacement of the latch bolt 452 relative to the latch bar 450. For example, rotation of the latch bolt 452 in a first direction, such as when the latch assembly 400 is being adjusted from the first backset setting to the second backset setting, may adjust the axial location of the latch bar 450 along the threaded retention rod 458, resulting, for example, in an increase in the distance between the first end 466*a* of the latch bar 450 and the rear side 460 of the latch bolt 452, as shown in FIG. 20. Conversely, rotation of the latch bolt 452 in a second, opposite direction, such as when the latch assembly 400 is being adjusted from the second backset setting to the first backset setting may adjust the axial location of the latch bar 450 along the threaded retention rod 458, resulting, for example, a decrease in the distance between the first end 466*a* of the latch bar 450 and the rear side 460 of the latch bolt 452, as shown in FIG. 19. Further, the retaining clip 454 may be structured to be retained on the retention rod 458 at a position that prevents the latch bar 450 from being disengaged from the retention rod 458.

The biasing element 406 may be positioned to bias the bolt assembly 404 toward the extended, locked position. According to the illustrated embodiment, the biasing element 406 may be a spring, such as, for example, a coil spring, having a first end 464*a* and a second end 464*b*. The first end 464*a* of the biasing element 406 may abut against the spacer or washer 408 or at least portion of the housing assembly 410. The second end 464*b* of the biasing element 406 may abut against the second end 464*b* of the latch bar 450, such as, for example, against one or more projections 468*a*, 468*b* that extend from upper and lower sides 470*a*, 470*b* of the outer wall 424 at the first end 466*a* of the latch bar 450. According to such an arrangement, the biasing force provided by the biasing element 406 may remain relatively constant regardless of whether the latch assembly 400 is at the first or second backset settings.

The hook plate 412 may be operably secured to the second end 448*b* of the outer housing 422, such as, for example, being secured within the interior region 446 by lancing. The hook plate 412 includes an opening 472 that is sized to receive the slideable displacement of at least a portion of the latch bar 450. However, the opening 472 may be configured to prevent rotational displacement of the latch bar 450 relative to the outer housing 422. For example, according to the illustrated embodiment, the outer wall 424 at least at the second end 466*b* of the latch bar 450 may have a generally rectangular shaped cross section that is similar to the rectangular shaped cross section of the opening 472 of the hook plate 412. According to such an embodiment, the opening 472 may be sized to prevent or minimize rotational displacement of the latch bar 450 within the opening 472.

According to certain embodiments, the inner housing 420 may be secured to the back plate 414 and/or face plate 402 such that axial and/or rotational displacement of the inner housing 420 relative to the outer housing 422 may translate into similar displacement of at least the latch bolt 452 relative to the latch bar 450. For example, when adjusting the latch assembly 400 from the first backset setting to the second backset setting, such as, for example, from a 2⅜ inch backset setting to a backset setting of 2¾ inches, rotation of the inner housing 420 relative to the outer housing 422 may coincide with rotation of the face and back plates 402, 414, as well as rotation of the latch bolt 452 relative to the latch bar 450. Moreover, as the inner housing 420 is rotated in a first direction relative to the outer housing 422, the engagement projection 438 may be displaced away from the first end 443*a* of, and along, the adjustment slot 442. According to the spiral or helical configuration of the adjustment slot 442, the displacement of the engagement projection 438 along the adjustment slot 442 may translate into the inner housing 420 being both rotably and axially displaced relative to at least the outer housing 422. Thus, as the engagement projection 438 is displaced from the first end 443*a* of the adjustment slot 442, as shown in FIG. 19, to the second end 443*b* of the adjustment slot 442, as shown in FIG. 20, the distance between the back plate 414 and a front edge 474 of the outer housing 422 may increase. Further, the rotation of the inner housing 420 in the first direction may coincide with the rotation of the face and back plates 402, 414, as well as the rotation of the latch bolt 452 in the first direction. Such rotation of the latch bolt 452 may translate in an adjustment in the relative position of the latch bar 450 along the retention rod 458 of the latch bolt 452. Moreover, as the latch bolt 452 is rotated in the first direction, the threaded engagement between the retention rod 458 and the aperture 462 of the latch bar 450 may adjust the relative position of the latch bar 450 on the retention rod 458, such as, for changing the latch bar 450 from being positioned along the retention rod 258 for the first backset position on the retention rod 458, as shown in FIG. 19, to being positioned along the retention rod 258 for the second backset position, as shown in FIG. 20.

When the latch assembly 400 is to be adjusted from the second backset setting to the first backset setting, the inner housing 420 may be rotatably displaced relative to the outer housing 422 in a second direction. Such relative rotation may result in the engagement projection 438 traveling along the adjustment slot 442 from the second end 443*b* to the first end 443*a* of the adjustment slot 442, with the axial distance between the back plate 414 and the front edge 474 of the outer housing 422 decreasing. Further, the rotation of the inner housing 420 in the second direction may coincide with the rotation of the face and back plates 402, 414, as well as the rotation of the latch bolt 452 in the second direction. Such rotation of the latch bolt 452 may translate in an adjustment in the relative axial position of the latch bar 450 along the retention rod 458 of the latch bolt 452, and more specifically, a decrease in the axial distance between the rear side 460 of the latch bolt 452 and the latch bar 450 as the relative distance between the latch bar 450 transitions from being positioned for the second backset position, as shown in FIG. 20, to being positioned for the first backset setting, as shown in FIG. 19.

While the invention has been described in connection with what is presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

The invention claimed is:

1. An apparatus, comprising:

a housing assembly comprising an inner housing and an outer housing; and a bolt assembly comprising a latch bolt, a retention rod, a latch bar, and a hook plate, at least a portion of the latch bar positioned within the inner housing, the retention rod threadedly engaged with the latch bar, at least the axial position of the latch bar relative to a rear side of the latch bolt being adjusted as the inner housing is rotatably and axially displaced relative to the outer housing from a first position to a second position;

wherein the bolt assembly further comprises a retaining clip configured to retain the latch bar in threaded engagement with the retention rod;

wherein the bolt assembly is operable to transition between a bolt assembly first length and a bolt assembly second length less than the bolt assembly first length by causing relative rotation of the retention rod and the latch bar while the retaining clip is coupled to the retention rod;

wherein the outer housing defines an interior region configured to receive the insertion of at least a portion of the inner housing, and placement of the hook plate; and wherein the hook plate defines an opening that is configured to receive the latch bar and is configured to prevent rotation of the latch bar relative to the outer housing.

2. The apparatus of claim 1, wherein the inner housing is coupled to the latch bolt, and wherein rotational displacement of the inner housing relative to the outer housing corresponds to rotational displacement of the latch bolt and retention rod relative to the latch bar.

3. The apparatus of claim 1, wherein the outer housing comprises an adjustment slot;

wherein the inner housing comprises an engagement projection positioned for displacement along the adjustment;

wherein the engagement projection is positioned at a first end of the adjustment slot when the inner housing is at the first position; and wherein the engagement projection is positioned at a second, opposite end of the adjustment slot when the inner housing is at the second position.

4. The apparatus of claim 1, wherein the housing assembly further comprises a spacer mounted to the inner housing for displacement with the inner housing between the first position and the second position; and wherein a biasing member is engaged between the spacer and the latch bar.

5. The apparatus of claim 1, further comprising a biasing member mounted within the inner housing and engaged between the inner housing and the latch bar such that a biasing force of the biasing member remains approximately the same when the inner housing is displaced relative to the outer housing between the first position and the second position.

6. A method of adjusting a latch assembly comprising an adjustable housing assembly and an adjustable bolt assembly, the adjustable housing assembly including a first housing component and a second housing component rotatably coupled with the first housing component, the adjustable bolt assembly including a latch bolt and a latch rod threadedly coupled with the latch bolt, the method comprising:

causing relative rotation and relative axial movement of the first housing component and the second housing component to thereby adjust a length of the adjustable housing assembly from a housing assembly first length to a housing assembly second length; and causing relative rotation of the latch bolt and the latch rod to thereby adjust a length of the adjustable bolt assembly from a bolt assembly first length to a bolt assembly second length, wherein the bolt assembly first length is greater than the bolt assembly second length;

wherein a retention clip is mounted to the latch boll: and engages the latch rod when the adjustable bolt assembly has the bolt assembly first length, thereby preventing further expansion of the adjustable bolt assembly; and wherein a rear face of the latch bolt abuts and an adjacent component when the adjustable bolt assembly has the bolt assembly second length, thereby preventing further contraction of the adjustable bolt assembly; and wherein the retention clip remains mounted to the latch bolt during the relative rotation of the latch bolt and the latch rod; and wherein a hook plate is received within the first housing component, defining an opening configured to receive the latch rod to prevent relative rotation of the latch rod relative to the first housing component.

7. A latch assembly, comprising:

a housing assembly comprising a first housing component a second housing component movably engaged with the first housing component and a hook plate received within the first housing component;

an adjustable bolt assembly, comprising:

a latch bolt, wherein the latch bolt comprises a threaded retention rod; and a latch rod configured for connection to a component operable to move the adjustable bolt assembly between an extended latching position and a retracted unlatching position, wherein the latch rod comprises a threaded aperture into which the threaded retention rod extends, wherein the latchbolt is threadedly engaged with the latch rod such that relative rotation of the latch bolt and the latch rod adjusts a length of the adjustable bolt assembly between a bolt assembly first length and a bolt assembly second length less than the bolt assembly first length; and a retention clip mounted to an end of the threaded retention rod and preventing the threaded retention rod from exiting the threaded aperture;

wherein the adjustable bolt assembly is movably mounted in the housing assembly;

wherein the hook plate defines an opening that is configured to receive the latch rod and is configured to prevent rotation of the latch rod relative to the first housing component;

wherein the retention clip prevents extension of the bolt assembly beyond the bolt assembly first length;

wherein a rear face of the latch bolt prevents contraction of the bolt assembly beyond the bolt assembly second length by abutting an adjacent component of the bolt assembly when the bolt assembly has the bolt assembly second length; and wherein the bolt assembly is operable to move between the bolt assembly first length and the bolt assembly second length while the retention clip is mounted to the threaded retention rod.

8. The latch assembly of claim 7, wherein the second housing component is rotatably coupled with the first housing component such that relative rotation of the first housing component and the second housing component adjusts a length of the housing assembly between a housing assembly first length and a housing assembly second length less than the housing assembly first length.

9. The latch assembly of claim 8, wherein the latch assembly has a first configuration and a second configuration;

wherein, with the latch assembly in the first configuration, the adjustable bolt assembly has the bolt assembly first length and the housing assembly has the housing assembly first length; and wherein, with the latch assembly in the second configuration, the adjustable bolt assembly has the bolt assembly second length and the housing assembly has the housing assembly second length.

10. The latch assembly of claim 9, further comprising a biasing member mounted in one of the first housing component or the second housing component and engaged with the adjustable bolt assembly;

wherein a first biasing force exerted by the biasing member when the latch assembly is in the first configuration is approximately the same as a second biasing force exerted by the biasing member when the latch assembly is in the second configuration.

11. The latch assembly of claim 8, wherein the first housing component comprises an adjustment slot having a first end and an opposite second end longitudinally offset from the first end;

wherein the second housing component comprises a projection projecting into the adjustment slot; and wherein the first housing component and the second housing component are rotatable relative to one another between a first position in which the projection is seated in the first end of the adjustment slot and the housing has the housing assembly first length, and a second position in which the projection is seated in the second end of the adjustment slot and the housing has the housing assembly second length.

12. The latch assembly of claim 11, wherein the second housing component further comprises a deflectable engagement member; and wherein the projection is coupled to the deflectable engagement member such that deflection of the deflectable engagement member causes the projection to exit the adjustment slot.

13. The latch assembly of claim 11, wherein the adjustment slot is helical.

14. The latch assembly of claim 11, wherein the first housing component is an outer housing component; and wherein the second housing component is an inner housing component seated within the outer housing component.

15. A method of adjusting a latch assembly comprising an adjustable housing assembly and an adjustable bolt assembly, the adjustable housing assembly including a first housing component and a second housing component rotatably coupled with the first housing component, the adjustable bolt assembly including a latch bolt and a latch rod threadedly coupled with the latch bolt, the method comprising:

causing relative rotation and relative axial movement of the first housing component and the second housing component to thereby adjust a length of the adjustable housing assembly from a housing assembly first length to a housing assembly second length; and causing relative rotation of the latch bolt and the latch rod to thereby adjust a length of the adjustable bolt assembly from a bolt assembly first length to a bolt assembly second length, wherein the bolt assembly first length is greater than the bolt assembly second length;

wherein a retention clip is mounted to the latch bolt and engages the latch rod when the adjustable bolt assembly has the bolt assembly first length, thereby preventing further expansion of the adjustable bolt assembly; and wherein a rear face of the latch bolt abuts and an adjacent component when the adjustable bolt assembly has the bolt assembly second length, thereby preventing further contraction of the adjustable bolt assembly; and wherein the retention clip remains mounted to the latch bolt during the relative rotation of the latch bolt and the latch rod; and wherein a hook plate is received within the first housing component, defining an opening configured to receive the latch rod to prevent relative rotation of the latch rod relative to the first housing component-.

16. The method of claim 15, further comprising:

assembling the latch assembly, wherein assembling the latch assembly comprises:

movably mounting the adjustable bolt assembly in the adjustable housing assembly; and mounting the assembled latch assembly in an opening formed in a door.

17. The method of claim 15, wherein causing relative rotation and relative axial movement of the first housing component and the second housing component causes a projection of the second housing component to travel along an adjustment slot of the first housing component to thereby adjust the length of the adjustable housing assembly.

18. The method of claim 17, wherein the adjustment slot is helical such that causing relative rotation of the first housing component and the second housing component causes relative axial movement of the first housing component and the second housing component.

19. The method of claim 15, wherein causing relative rotation of the latch bolt and the latch rod causes a threaded retention rod of the latch bolt to rotate within a threaded aperture of the latch rod to thereby adjust the length of the adjustable bolt assembly.

20. The method of claim 15, wherein the first housing component comprises an adjustment slot;

wherein the second housing component comprises a deflectable engagement member having a projection mounted thereon;

wherein one of the first housing component or the second housing component is an outer housing component;

wherein the other of the first housing component or the second housing component is an inner housing component operable to be inserted into the outer housing component when the deflectable engagement member is deflected from a first position to a second position; and wherein the method further comprises:

deflecting the deflectable engagement member from the first position to the second position to permit insertion of the inner housing component into the outer housing component;

inserting the inner housing component into the outer housing component; and permitting the deflectable engagement member to return from the second position to the first position, thereby causing the projection to enter the adjustment slot.

* * * * *